US010272545B2

(12) United States Patent
Wang

(10) Patent No.: US 10,272,545 B2
(45) Date of Patent: Apr. 30, 2019

(54) LOCKING PLIERS

(71) Applicants: HANGZHOU GREAT STAR TOOLS CO., LTD., Hangzhou (CN); HANGZHOU GREAT STAR INDUSTRIAL CO., LTD., Hangzhou (CN)

(72) Inventor: Min Wang, Hangzhou (CN)

(73) Assignee: HANGZHOU GREAT STAR TOOLS CO., LTD., Hangzhou (CN)

( * ) Notice: Subject to any disclaimer, the term of this patent is extended or adjusted under 35 U.S.C. 154(b) by 197 days.

(21) Appl. No.: 15/327,022

(22) PCT Filed: Jul. 18, 2014

(86) PCT No.: PCT/CN2014/082493

§ 371 (c)(1),
(2) Date: Jan. 17, 2017

(87) PCT Pub. No.: WO2016/008153

PCT Pub. Date: Jan. 21, 2016

(65) Prior Publication Data

US 2017/0173763 A1 Jun. 22, 2017

(51) Int. Cl.
*B25B 7/12* (2006.01)

(52) U.S. Cl.
CPC ..... *B25B 7/123* (2013.01)

(58) Field of Classification Search
CPC .. B25B 7/123; B25B 7/02; B25B 7/10; B25B 7/04; B25B 5/12
See application file for complete search history.

(56) References Cited

U.S. PATENT DOCUMENTS 5,456,144 A 10/1995 Dahl et al.
6,227,081 B1 * 5/2001 Bally ..... B25B 7/12 81/355
6,327,943 B1 * 12/2001 Wrigley ..... B25B 7/02 81/405
6,450,070 B1 9/2002 Ringer et al.
(Continued)

FOREIGN PATENT DOCUMENTS

CN 1122116 A 5/1996
CN 201033416 Y 3/2008
(Continued)

OTHER PUBLICATIONS

International Search Report, dated Jan. 26, 2015, PCT Application No. PCT/CN2014/082493, filed Jul. 18, 2014, 4 pages.

*Primary Examiner* — Robert J Scruggs
(74) *Attorney, Agent, or Firm* — Haynes and Boone, LLP

(57) ABSTRACT

An example pair of locking pliers comprises a first gripping head, a second gripping head, a first handle and a second handle, the first gripping head being mounted to the first handle, the second gripping head being pivotably mounted to the first handle and pivotably mounted to the second handle via a first joint. The pair further comprises a single connecting rod, a sliding mechanism and a locking mechanism, one end of the connecting rod mechanism being pivotably mounted to the second handle via a second joint, the other end being pivotably mounted to the sliding mechanism via a third joint, the sliding mechanism and the locking mechanism being slidably mounted to the first handle.

11 Claims, 4 Drawing Sheets

(56) References Cited

U.S. PATENT DOCUMENTS

| | | | | |
|---|---|---|---|---|
| 6,591,791 | B2 | 7/2003 | De Bei | |
| 6,776,072 | B2 | 8/2004 | Poole et al. | |
| 2004/0000212 | A1* | 1/2004 | Kesinger ..... | B25B 7/123<br>74/531 |

FOREIGN PATENT DOCUMENTS

| | | | |
|---|---|---|---|
| CN | 101704227 | A | 5/2010 |
| CN | 103481217 | A | 1/2014 |
| EP | 2614924 | A1 | 7/2013 |
| WO | 99/37445 | A1 | 7/1999 |

* cited by examiner

LOCKING PLIERS

CROSS REFERENCE TO RELATED APPLICATIONS

The present application is a national stage entry of the PCT Patent Application No. PCT/CN2014/082493, filed Jul. 18, 2014, which is hereby incorporated by reference in its entirety.

TECHNICAL FIELD

The present application relates to a hand tool, particularly to a pair of locking pliers.

DESCRIPTION OF THE PRIOR ART

Locking pliers are mainly used for gripping parts so as to process the parts, such as gripping parts for processing of riveting, welding, grinding and the like. Compared with ordinary pliers, the jaw of locking pliers can generate greater gripping force so that the processing will not be influenced by looseness of the parts. Furthermore, locking pliers can also be used as wrench.

Ordinary pliers generally include pliers head and handles. The force acting on handles is changed into greater acting force on pliers head via a transition of lever principle. But once the force acting on the handles disappears, the jaws will be released naturally and will not continue gripping the workpiece. The locking pliers use lever principle twice, so the force acting on the handles is changed via lever principle twice, and the gripping force which is several times of the applied force is produced at the jaws ultimately.

U.S. Pat. Nos. 6,591,791 and 6,776,072 disclose a pair of adjustable locking pliers, wherein the distance between the jaws does not need to be pre-adjusted and tight locking can be achieved when the jaws grip different sizes of workpieces. The connecting rod assembly of the locking pliers between the two handles includes an arm and a cam, the arm being pivotally connected to the handle, the cam being pivotally connected to the arm, and a locking element being pivotally connected to the cam. An adjustment element is mounted to the arm and capable of interacting with the cam. By adjusting the position of the adjusting component, the aim of adjusting the gripping force of the jaws can be achieved. It can be seen from the description of the above patents that intermediate connecting rods of the arm and the cam exist between the force input point on the handle and the locking element to achieve the locking, which lead to weak supporting rigidity. Furthermore, it can be seen from the description and the drawings of the above patents that the locking element is a locking block, which achieves the locking via the change of the angle between the locking block and a guide rod. However, considering the effectiveness of the locking, a single locking block needs high precision to be able to form a fit with the guide rod to generate a friction force in order to lock effectively. But high producing precision needs precious casting, while the production cost of precious casting is high. During the assembling process of locking pliers, except the locking block, which can be rapidly penetrated by the guide rod, the other components such as the cam, the arm and the adjusting element need to be assembled respectively, and the assembling process is relatively complicated.

Therefore, the existing locking pliers have defects that the supporting rigidity of the connecting rod part is not strong, the effectiveness of the locking is not high, the production cost is high and the assembling is complicated.

SUMMARY

The distal end of the invention means the end far away from a gripping head, while the proximal end means the end near the gripping head.

Considering that locking pliers of the prior art have defects that the supporting rigidity of the connecting rod part is not strong, the effectiveness of the locking is not high, the production cost is high and the assembling is complicated, the present invention provides a pair of locking pliers with strengthened supporting rigidity of the connecting rod part, improved effectiveness of the locking, reduced production cost and less complicated assembling.

A pair of locking pliers of the present invention comprises a first gripping head, a second gripping head, a first handle and a second handle, the first gripping head being mounted to the first handle, the second gripping head being pivotably mounted to the first handle and pivotably mounted to the second handle via a first joint, characterized in that the pair of locking pliers further comprises a single connecting rod and a sliding mechanism, one end of the connecting rod being pivotably mounted to the second handle via a second joint, the other end being pivotably mounted to the sliding mechanism via a third joint, the sliding mechanism being slidably mounted to the first handle; a locking mechanism for locking the locking pliers; and an adjusting mechanism for adjusting the gripping force of the locking pliers.

Further, the end of the connecting rod which connects to the sliding mechanism consists of curve segments, and the curvature of the curve segment close to the first handle is larger than that away from the first handle.

Further, the connecting rod is made of high-strength material such as medium-carbon and high-strength carbon structural steel or high-carbon steel.

Further, the connecting rod is mounted to the second handle via a rivet at the second joint and to the sliding mechanism via a pin at the third joint.

Further, the locking mechanism of the locking pliers of the present invention can be slidably mounted to the second handle, and located on the side of the sliding mechanism close to the distal end of the first handle.

Further, the locking mechanism comprises a guide rod and locking plates, the guide rod being arranged through the locking plates and mounted to the first handle.

Further, the locking plates are multiple stacked plates, and the multiple locking plates cling to each other.

Further, the cross-section of the guide rod is a rounded trapezoid and a hole for the guide rod to pass through is arranged in the middle of the locking plates, the hole being arranged to be provided with a rounded trapezoid in the same shape with the cross-section of the guide rod, the fit between the guide rod and the locking plates being a clearance fit.

Further, the adjusting mechanism of the locking pliers is mounted to the guide rod between the sliding mechanism and the locking mechanism, and the adjusting mechanism is configured to be capable of moving along the length of the guide rod.

Further, the adjusting mechanism is configured such that when the adjusting mechanism reaches the maximum displacement towards either end of the guide rod and the pair of locking pliers is locking, the end of the guide rod connecting to the sliding mechanism can contact with the adjusting mechanism.

Further, the adjusting mechanism comprises an adjusting screw and a carrier, the carrier being mounted to the guide rod, the adjusting screw being mounted to the carrier and able to move along the guide rod relative to the carrier.

Further, the cross-section of the carrier is the same as that of the locking plates and has a hole with the same shape and size and at the same position as that of the locking plates, the guide rod passing through the hole in the carrier.

Further, the pair of locking pliers also comprises a third handle, which is pivotably mounted to the second handle and is configured such that: when the end of the third handle away from the pivot point is approaching the second handle, the end of the third handle close to the pivot point can act on the connecting rod.

Further, the part of the connecting rod interacting with the third handle is provided with an arc-shaped projection.

Optionally, the pair of locking pliers of the present invention comprises a first gripping head, a second gripping head, a first handle and a second handle, the first gripping head being mounted to the first handle, the second gripping head being pivotably mounted to the first handle and pivotably mounted to the second handle via a first joint, characterized in that the pair of locking pliers further comprises a connecting rod mechanism and a sliding mechanism, one end of the connecting rod mechanism being pivotably mounted to the second handle via a second joint, the other end being pivotably mounted to the sliding mechanism via a third joint, the sliding mechanism being slidably mounted to the first handle.

Further, the connecting rod mechanism is a single connecting rod.

Further, the end of the connecting rod which connects the sliding mechanism is a curve and the curvature of the part thereof close to the first handle is larger than that of the part thereof away from the first handle.

Further, the pair of locking pliers of the present invention also comprises a locking mechanism, which can be slidably mounted to the second handle, and located on the side of the sliding mechanism close to the distal end of the first handle.

Further, the locking mechanism comprises a guide rod and locking plates, the guide rod being arranged through the locking plates and mounted to the first handle.

Further, the pair of locking pliers also comprises an adjusting mechanism, which is mounted to the guide rod between the sliding mechanism and the locking mechanism, and the adjusting mechanism is configured to be capable of moving along the length of the guide rod.

Further, the adjusting mechanism comprises an adjusting screw and a carrier, the carrier being mounted to the guide rod, the adjusting screw being mounted to the carrier and able to move along the guide rod relative to the carrier.

Further, the pair of locking pliers also comprises a third handle, which is pivotably mounted to the second handle and is configured such that: when the end of the third handle away from the pivot point is approaching the second handle, the end of the third handle close to the pivot point can act on the connecting rod.

Further, the part of the connecting rod interacting with the third handle is provided with an arc-shaped projection.

The pair of locking pliers of the present invention can grip all kinds of workpieces regardless of their sizes, as long as the sizes are not bigger than the maximum distance between the two gripping heads of the locking pliers, and there is no need to pre-adjust the distance between the gripping heads to accommodate the sizes of different workpieces. The accommodation to workpieces with different sizes mainly depends on the moving distance of the sliding block on the guide rod.

The connecting rod of the locking pliers of the present invention is a single connecting rod with one end connected to the handle and the other end connected to the sliding mechanism, and the connecting rod is made of high-strength materials, which can improve the supporting rigidity of the connecting rod.

The match between the adjusting mechanism and the connecting rod can adjust the gripping force between the gripping heads. When the interaction between the adjusting mechanism and the connecting rod occurs earlier, which means that after the adjusting mechanism of the present invention moves towards the gripping head, the initial angle between the second handle and the connecting rod turns bigger when the locking begins, therefore the gripping force generated at the gripping head will also be increased. When the interaction between the adjusting mechanism and the connecting rod occurs later, which means that after the adjusting mechanism of the present invention moves away from the gripping head, the initial angle between the second handle and the connecting rod turns smaller when the locking begins, therefore the gripping force generated at the gripping head will also be reduced.

Furthermore, the locking mechanism consists of multiple locking plates, which can follow a sequential order when inclining and generating a frictional effect to the guide rod to lock it. And the multiple locking plates can carry out the locking when part of them can generate a friction force to the guide rod. When the effective friction force between the locking plates and the guide rod is great, a more effective locking can be generated. When the second joint is located at the position on the line between the first joint and the third joint and near the side of the first handle, the generated locking effect can be maintained after the exerted force has been withdrawn.

The arrangement of multiple locking plates reduces the requirement of punching precision of the locking plates and thus reduces the cost of manufacture. Furthermore, the sliding mechanism, the adjusting mechanism and the locking mechanism are all provided with holes for the guide rod to pass through. The above three mechanisms can be simply rapidly penetrated by the guide rod when being assembled, so the process of the assembly is uncomplicated.

DETAILED DESCRIPTION

Figure 1:
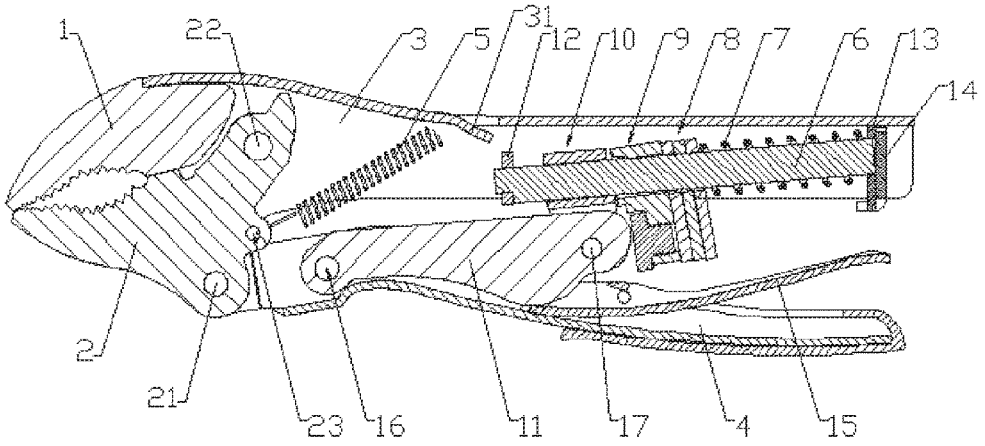
FIG. 1 is a sectional view in a locking state without gripping workpiece of the locking pliers in one embodiment of the present invention.

As shown in FIG. 1, in one embodiment of the locking pliers of the present invention, the locking pliers comprises a first gripping head 1, a second gripping head 2, a first handle 3 and a second handle 4. The first gripping head 1 is fixedly mounted to the first handle 3. The second gripping head 2 is roughly an L shape, which is mounted to the second handle 4 via a first joint 21 located at the turning point of the L shape, while one arm of the L shape of the second gripping head 2 is further mounted to the first handle 3 via a fourth joint 22. The second gripping head 2 is mounted to the second handle 4 via a rivet at the first joint 21 and to the first handle 3 via a rivet at the fourth joint 22. The second gripping head 2 can pivot around the first joint 21 relative to the second handle 4 and can also pivot around the fourth joint 22 relative to the first handle 3.

A hole 23 is arranged between the first joint 21 and the fourth joint 22 of the second gripping head 2, where one end of a first spring 5 is connected while the other end of the first spring 5 is connected to the back of the first handle 3. Specifically, the back of the first handle 3 is provided with an inwardly-depressed section 31 and the first spring 5 is connected to the first handle 3 via the inwardly-depressed section 31. A person skilled in the art knows that the first spring 5 can also be connected to the first handle 3 in other ways. The above inwardly-depressed section 31 is connected to the first handle 3 at the position close to the first gripping head 1 and depressed inwardly into the first handle 3 at the position away from the first gripping head 1. The position of the inwardly-depressed section 31 on the first gripping head 3 is closer to the distal end of the first handle 3 relative to the position of the second gripping head 2. The first spring 5 is a tension spring, when the pair of locking pliers is in an open position, the first spring 5 will pull the second gripping head 2 away from the first gripping head 1 because of the resilience, which produces the biggest opening position between the first gripping head 1 and the second gripping head 2.

Figure 2:
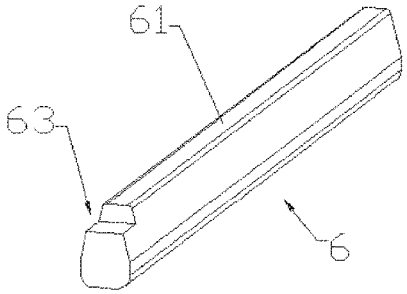
FIG. 2 is a schematic diagram of the guide rod of the locking pliers in one embodiment of the present invention.
Figure 3:
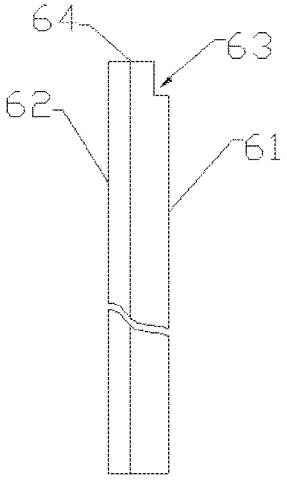
FIG. 3 is a side view of the guide rod of the locking pliers in one embodiment of the present invention.
Figure 4:
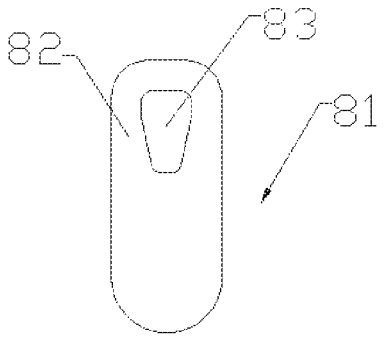
FIG. 4 is a schematic diagram of the locking plates of the locking pliers in one embodiment of the present invention.

As shown in FIG. 2 and FIG. 3, the cross-section of a guide rod 6 is a rounded trapezoid, which means the shape of the main body of the guide rod 6 is isosceles trapezoid with the length of the upper surface 61 being less than that of the lower surface 62 and the four corners of the isosceles trapezoid are rounded for transition. At one end 64 of the guide rod 6, the upper surface 61 of the rounded trapezoid is provided with a notch 63. A second spring 7 is mounted to the guide rod 6 at the part close to the distal end of the first handle 3. A locking mechanism 8 is arranged penetrated by the guide rod 6 at the proximal end of the second spring 7 (which is the end near the gripping head). Further, in this embodiment, the locking mechanism 8 consists of three locking plates 81. A person skilled in the art knows that the number of the locking plates 81 is changeable, and the effect of locking will be better when the number of the locking plates 81 increases. As shown in FIG. 4, the upper part 82 of the locking plates 81 is provided with a rounded trapezoid-hole 83 in the same shape as the cross-section of the guide rod 6. The locking plates 81 realize a clearance fit with the guide rod 6 via the rounded trapezoid-hole 83. The three locking plates are mounted to the guide rod 6 in proper order.

Figure 5:
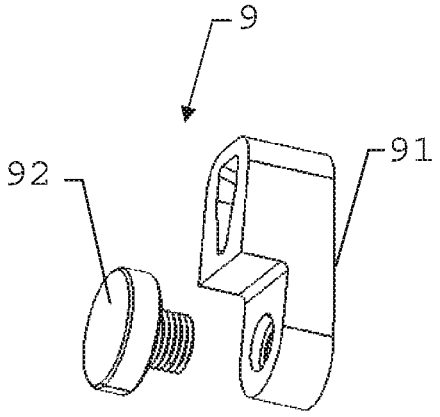
FIG. 5 is a schematic diagram of the adjusting mechanism of the locking pliers in one embodiment of the present invention.
Figure 6:
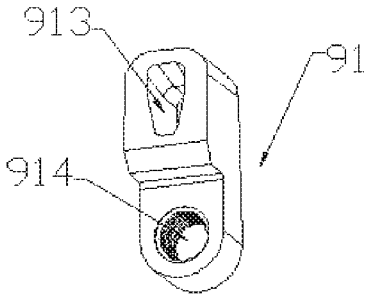
FIG. 6 is a schematic diagram of the carrier of the adjusting mechanism of the locking pliers in one embodiment of the present invention.
Figure 7:
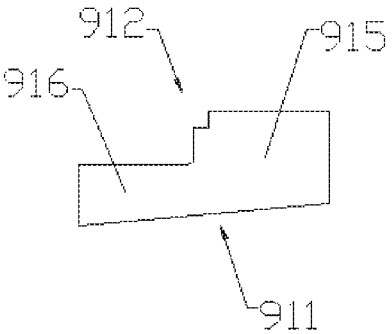
FIG. 7 is a side view of the carrier of the adjusting mechanism of the locking pliers in one embodiment of the present invention.

An adjusting mechanism 9 is mounted on the side close to the gripping head of the locking mechanism 8. Further, in this embodiment, the adjusting mechanism 9 consists of a carrier 91 and an adjusting screw 92 (as shown in FIG. 5). As shown in FIG. 6 and FIG. 7, the two sides of the carrier 91 are a plane surface 911 and a step surface 912 respectively. The plane surface 911 inclines upward along the rising direction of the step surface 912 and is provided with a cross-section in the same shape as that of the locking plates 81, fitting the locking plates 81. The step surface 912 of the carrier 91 faces to the side of the gripping head of the locking pliers. A protrusion part 915 of the step surface 912 of the carrier 91 is provided with a through-hole 913, via which the carrier 91 is mounted to the guide rod 6. The shape of the cross-section of the through-hole 913 is roughly the same as that of the guide rod 6, and the part of the through-hole 913 close to the step surface 912 expands in a trumpet shape. During the locking process, the part expanding in a trumpet shape allows the carrier 91 to swing towards the distal end of the handle relative to the guide rod 6, which exerts an acting force to the locking plates 81 and generates a friction force between the locking plates 81 and the guide rod 6. A lower step part 916 of the step surface 912 of the carrier 91 is provided with a through-hole 914 and the adjusting screw 92 is arranged in the through-hole 914, which can move along the through-hole. The head of the adjusting screw 92 faces to the gripping head.

Figure 8:
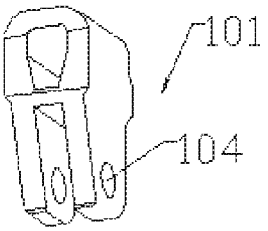
FIG. 8 is a schematic diagram of the sliding block of the locking pliers in one embodiment of the present invention.
Figure 9:
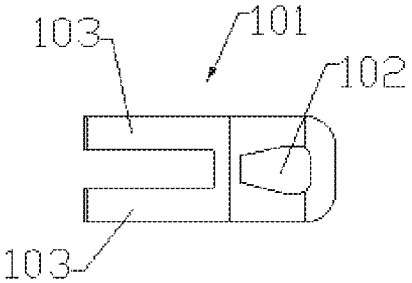
FIG. 9 is a top view of the sliding block of the locking pliers in one embodiment of the present invention.

A sliding mechanism 10 is mounted on the side close to the gripping head of the adjusting mechanism 9. Further, in this embodiment, the sliding mechanism 10 is a sliding block 101. As shown in FIG. 8 and FIG. 9, the structure of the sliding block 101 is U-shaped and the joint of the U-shape is provided with a rounded trapezoid-shaped hole 102. The rounded trapezoid-shaped hole 102 of the sliding block 101 and the rounded trapezoid-shaped hole 83 of the locking plates 81 have the same size, and the sliding block 101 is arranged passed through by the guide rod 6 via the rounded trapezoid-shaped hole 102 therein. Through-holes 104 are arranged in the two arms 103 of the U-shaped structure of the sliding block 101.

Figure 10:
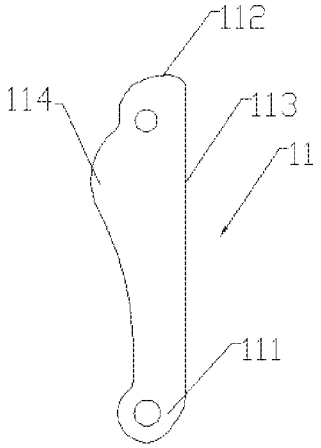
FIG. 10 is a schematic diagram of the guide rod of the locking pliers in one embodiment of the present invention.
Figure 11:
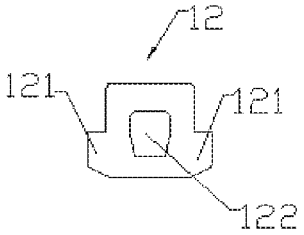
FIG. 11 is a schematic diagram of the first supporting plate of the locking pliers in one embodiment of the present invention.
Figure 12:
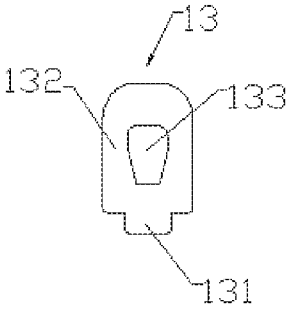
FIG. 12 is a schematic diagram of the second supporting plate of the locking pliers in one embodiment of the present invention.
Figure 13:
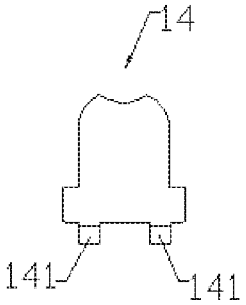
FIG. 13 is a schematic diagram of the third supporting plate of the locking pliers in one embodiment of the present invention.

As shown in FIG. 1 and FIG. 10, one end 111 of a connecting rod 11 is mounted to the second handle 4 via a rivet, and the other end 112 is mounted between two arms 103 of the sliding block 101 via a pin. A person skilled in the art knows that the connection between the connecting rod 11 and the second handle 4 as well as the sliding block 101 can be in other ways. The end 112 of the connecting rod 11 is a curve of several segments, the curvature of the curve segment of the end 112 close to the back 113 of the connecting rod is big, while the curvature of the curve segment away from the back 113 is small. The end 112 of the connecting rod 11 is configured to be capable of contacting with the adjusting screw 92 of the adjusting mechanism 9 when gripping the workpieces. During the process of gripping, the connecting rod is allowed to push the sliding block 101 to move towards the distal end of the handle because of the existence of the small-curvature curve segment of the connecting rod 11. After the connecting rod 11 rotates around a second joint 16 to a certain degree, the big-curvature curve segments begins to contact with the adjusting screw 92 and exert an acting force to the adjusting screw 92, then the adjusting screw 92 transmits the acting force to the carrier 91 and further to the locking plates 81, and the locking can be achieved finally. Therefore, the arrangement of curve segments with different curvatures at the end 112 of the connecting rod 11 allows that the distance between the two heads does not need to be pre-adjusted when the locking pliers is gripping workpieces of different sizes. The connecting rod 11 pushes the sliding block 101 via the small-curvature curve segment and acts on the adjusting screw 92 via the big-curvature curve segment to begin the locking and ensures that the angle formed by the connecting rod 11 and the second handle is consistent, thereby the self-adjusting function of the gripping head can be realized. The connecting rod 11 is also provided with a circular arc-shaped projection 114 located on the side opposite to the back 113 of the connecting rod.

As shown in FIGS. 1, 11, 12 and 13, the guide rod 6 is mounted to the first handle 3 via a first supporting plate 12, a second supporting plate 13 and a third supporting plate 14. In which, the first supporting plate 12 is T-shaped, and the two ends 121 extended by the T shape can make an interference fit with a recess arranged on the first handle 3 to be mounted to the first handle 3. A person skilled in the art knows that the first supporting plate 12 can also mounted to the first handle 3 in some ways such as welding and the like. A hole 122 is arranged in the middle of the first supporting plate 12 and the hole 122 is a rounded trapezoid, which is able to have a transition fit with the end having the notch 63 of the guide rod 6. The second supporting plate 13 and the third supporting plate 14 are matched to be used. The second supporting plate 13 is provided with a projection part 131, and the diameter of the projection part 131 is smaller than that of the body 132 of the second supporting plate 13. A hole 133 is arranged in the middle of the second supporting plate 13 and the hole 133 is a rounded trapezoid, which is able to have a transition fit with the end without the notch 63 of the guide rod 6. The third supporting plate 14 is T-shaped, the T shape is provided with two projections 141 which are symmetric along the center line, the projections 141 extend a certain distance towards the end of the third supporting plate 14, and the two ends extended by the T shape of the third supporting plate 14 can make an interference fit with a recess arranged on the first handle 3. A person skilled in the art knows that the third supporting plate 14 can also be mounted to the first handle 3 in other ways such as welding and the like. The second supporting plate 13 and the third supporting plate 14 fit with each other to be used, and the projection part 131 of the second supporting plate 13 is engaged with the space defined between the two projections 141 of the third supporting plate 14. The third supporting plate 14 is not provided with any opening hole in the middle thereof, and the side of the third supporting plate 14 provides a certain supporting action for the guide rod 6.

Figure 14:
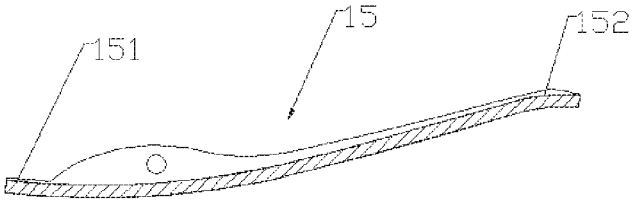
FIG. 14 is a schematic diagram of the third handle of the locking pliers in one embodiment of the present invention.

As shown in FIG. 1 and FIG. 14, the pair of locking pliers in this embodiment is also provided with a third handle 15, and the third handle 15 is circular arc-shaped and pivotably mounted to the second handle 4 via a rivet. A person skilled in the art knows that the third handle 15 can also be pivotably mounted to the second handle 4 in other ways. One end 151 of the third handle 15 can contact with the projection 114 of the connecting rod 11 in certain circumstances and exerts force to the projection 114. The other end 152 of the third handle 15 can be close to or away from the second handle 4 with the pivot of the third handle 15. When the end 152 is close to the second handle 4, the end 151 will be away from the second handle 4; when the end 152 is away from the second handle 4, the end 151 will be close to the second handle 4.

Figure 15:
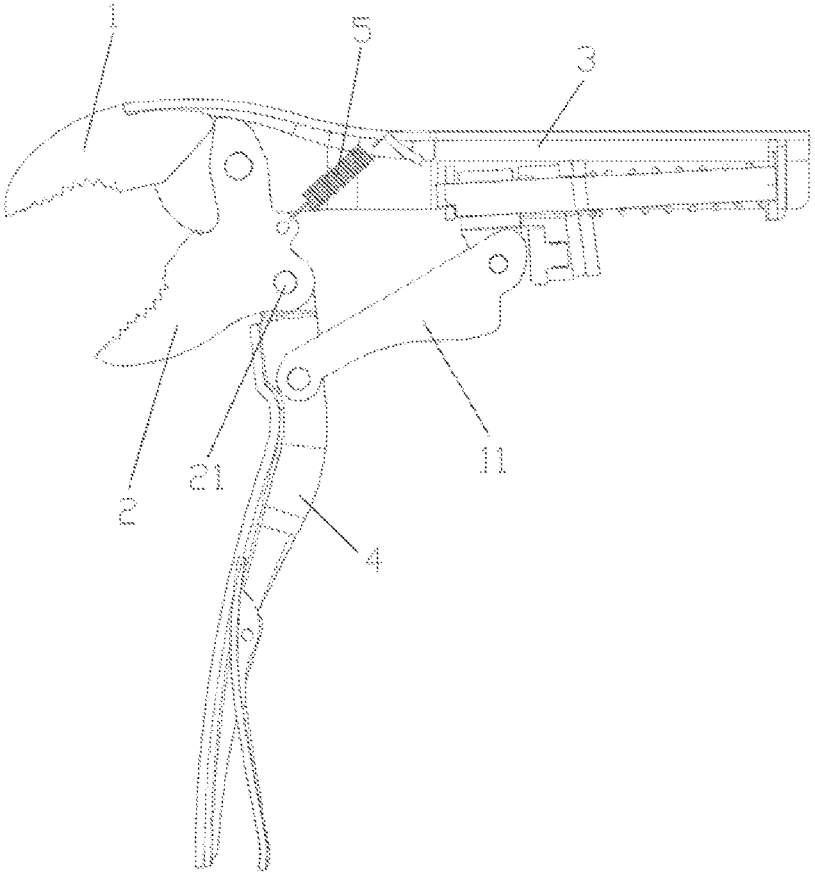
FIG. 15 is a sectional view in an open state of the locking pliers in one embodiment of the present invention.

As shown in FIG. 15, when the pair of locking pliers in this embodiment is in an open state, because of the action of the resilience of the first spring 5, a tension is applied to the contact point of the first spring 5 and the second gripping head 2 on the second gripping head 2, which detaches the second gripping head 2 from the first gripping head 1 to the maximum opening. When the second gripping head 2 reaches the position of the maximum opening, the second gripping head 2 will exert an acting force to the second handle 4 via the first joint 21 to make the second handle 4 pivot around the first joint 21, which makes the intersection angle between the first handle 3 and the second handle 4 turn into maximum. The connecting rod 11 limits the maximal degree of the intersection angle between the first handle 3 and the second handle 4.

Figure 16:
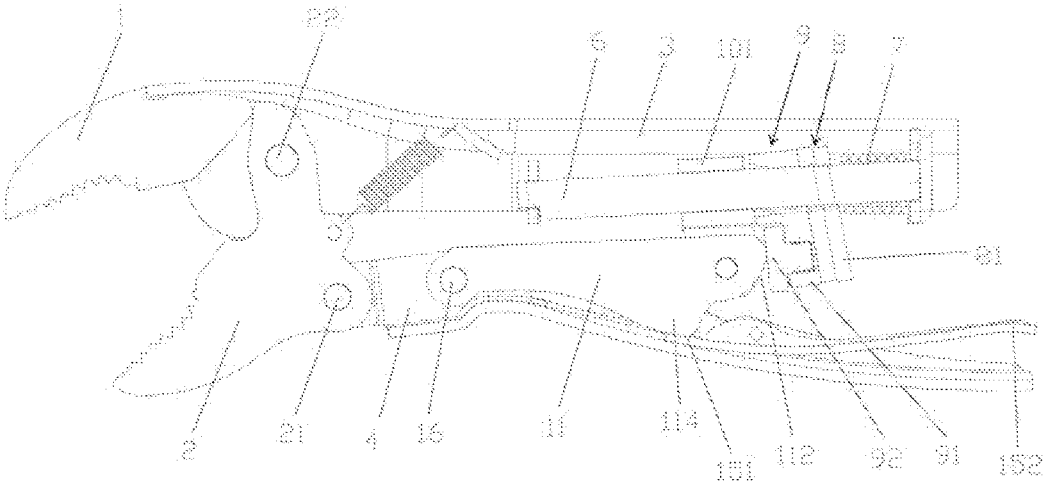
FIG. 16 is a sectional view in a locking state with gripping workpiece of the locking pliers in one embodiment of the present invention.

When the pair of locking pliers in this embodiment is gripping workpiece, the state thereof is as shown in FIG. 16. When gripping things, the user can hold the first handle 3 by palm, pull the second handle 4 by finger, and exert a force towards the first handle 3 to the second handle 4 to drive the second handle 4 to pivot around the first joint 21. Under the action of the second handle 4, the second gripping head 2 pivots around the fourth joint 22 and approaches the first gripping head 1 gradually. After the first gripping head 1 and the second gripping head 2 cling to the workpiece, the relative positions of the first gripping head 1 and the second gripping head 2 will no longer be changed, and the two gripping heads are roughly parallel. Under the action of the force exerted by the user, the second handle 4 continues moving towards the first handle 3 around the first joint 21. During the process, the connecting rod 11 experiences an acting force transmitted from the second joint 16, and because the connecting rod 11 is a rigid structure, the connecting rod 11 will force the sliding block 101 to move along the guide rod 6 towards the distal end of the first handle; during the process, the relative positions of the two gripping heads will not be changed. The sliding block 101 is successively connected to the adjusting mechanism 9, the locking mechanism 8 and the second spring 7, under the action of the sliding block 101, the adjusting mechanism 9 and the locking mechanism 8 also move along the guide rod 6 towards the distal end of the first handle, and the locking mechanism stresses the second spring 7 to compress. When the second spring 7 is compressed to a certain degree, the end 112 of the connecting rod 11 will contact with the head 921 of the adjusting screw 92 of the adjusting mechanism 9. As shown in FIG. 1, when the pair of locking pliers in this embodiment is not gripping workpiece, the compression degree of the second spring 7 in locking state is less than that in the state of gripping workpiece. The bigger the gripped workpiece is, the greater the compression degree of the second spring 7 will be.

After the end 112 of the connecting rod 11 contacts with the head 921 of the adjusting screw 92, the force exerted on the second handle 4 will further act on the adjusting screw 92. Since a clearance fit is between the carrier 91 of the adjusting mechanism 9 and the guide rod 6 and the through-hole 913 of the carrier 91 is an expanding hole in a shape of trumpet, under the acting force towards the distal end of the first handle 3 exerted by the adjusting screw 92, the carrier 91 will incline relative to the guide rod 6. The incline of the carrier 91 further acts on the locking plates 81 and the locking plates 81 incline respectively relative to the guide rod 6. After the locking plates 81 incline to a certain degree, the edges of the rounded trapezoid-holes 83 of the locking plates 81 generate a friction force to the guide rod 6; and when the second joint 16 is on the side near the first handle of the line linking the first joint 21 and the third joint 17, the locking pliers will lock and the gripping force of the gripping head will not disappear due to the disappearance of the force exerted on the handle after locking. During the process, a plurality of locking plates 81 reduce the requirement of punching precision of the locking plates to some extent, which allows gaps to exist between the locking plates 81; after a certain inclination angle is formed between the locking plates 81 and the guiding rod 6, the locking plates 81 will always generate a friction force to the guide rod 6 to achieve the locking. At this time, the projection 114 on the connecting rod 11 will press against one end 151 of the third handle 15 to make the end 151 cling to the second handle 4, while the other end 152 will leave the second handle 4. After locking, the locking pliers can grip the workpiece firmly.

When there is a need to discharge the griped workpiece, at first a force towards the second handle 4 is exerted at the end 152 of the third handle 15, then the third handle 15 rotates around a pivot while the end 151 moves away from the second handle 4 and generates an acting force to the projection 114 of the connecting rod 11 to make it be away from the second handle 4. Under the action of the acting force, the connecting rod 11 pivots around the second joint 16 and the end 112 of the connecting rod 11 moves relative to the adjusting screw 92, thus the acting force to the adjusting screw 92 is reduced gradually. Afterwards, forces in opposite directions are exerted to the first handle 3 and the second handle 4 to detach the end 112 of the connecting rod 11 and the adjusting screw 92. During the process, the inclination angle between the carrier 91 of the adjusting mechanism 9 and the locking plates of the locking mechanism 8 recovers to the original degree, and the friction force to the guide rod 6 is reduced and the locking is released. Under the action of the resilience of the second spring 7, the locking mechanism 8, the adjusting mechanism 9 and the sliding mechanism 10 move towards the gripping head along the guide rod 6. Afterwards, under the action of the pushing force from the connecting rod 11 and the force generated by the pulling force from the first spring 5 to the second gripping head 2 at the first joint 21, the second handle 4 pivots away from the first handle 3 until the opening reaches the maximal degree, then the operation of discharging workpieces is completed.

The adjusting screw 92 can move in the through-hole 914 of the carrier 91. When the adjusting screw 92 moves a certain distance towards the gripping head, the connecting rod 11 will contact with the adjusting screw 92 earlier than before the movement. It means that from the beginning of the locking, which occurs after the locking plates 81 have inclined to generate a friction force to the guide rod 6, until after the locking is finally completed, the gripping force formed between the two gripping heads is greater than that before the movement. In other words, a greater gripping force can be generated when the adjusting screw 92 moves towards the gripping head. On the contrary, when the adjusting screw 92 moves a certain distance away from the gripping head, the connecting rod 11 will contact with the adjusting screw 92 later than before the movement. It means that from the beginning of the locking, which occurs after the locking plates 81 have inclined to generate a friction force to the guide rod 6, until after the locking is finally completed, the gripping force formed between the two gripping heads is smaller than that before the movement. In other words, a weaker gripping force can be generated when the adjusting screw 92 moves away from the gripping head.

According to the test, when a pressure transducer with a thickness of 25 mm is gripped between the two gripping heads of the locking pliers in this embodiment and a load of 15 kg is exerted to the end of the second handle, the gripping force between the two gripping heads is 350 kg. When a round bar of 20 mm is gripped and a load of 12.8 kg is exerted to the second handle, the maximum torque force between the two gripping heads is 52 N*M. When a hexagon bar with opposite sides of 20 mm is gripped and a load of 14.5 kg is exerted to the second handle, the maximum torque force between the two gripping heads is 103.5 N*M.

The disclosure has been exemplified above with reference to specific embodiments. It should be understood that a multitude of modifications and varieties can be made by a common person skilled in the art based on the concepts of the present disclosure. Therefore, any technical schemes, acquired by the person skilled in the art based on the concepts of the present disclosure through logical analyses, deductions or limited experiments, fall within the scope of the invention as specified in the claims.

The invention claimed is:

1. A pair of locking pliers, comprising:

a first gripping head;

a second gripping head;

a first handle;

a second handle;

a locking mechanism for locking the locking pliers;

an adjusting mechanism for adjusting a gripping force of the locking pliers;

a single connecting rod; and a sliding mechanism;

wherein:

the first gripping head is mounted to the first handle;

the second gripping head is pivotably mounted to the first handle and pivotably mounted to the second handle via a first joint;

the locking mechanism comprises a guide rod and locking plates;

the guide rod is arranged through the locking plates and mounted to the first handle;

one end of the guide rod is pivotably mounted to the second handle via a second joint and an other end is pivotably mounted to the sliding mechanism via a third joint;

the sliding mechanism is slidably mounted to the first handle;

the adjusting mechanism is mounted to the guide rod between the sliding mechanism and the locking mechanism;

the adjusting mechanism is configured to be capable of moving along a length of the guide rod; and the adjusting mechanism comprises an adjusting screw and a carrier, the carrier being mounted to the guide rod, the adjusting screw being mounted to the carrier and able to move along the guide rod relative to the carrier.

2. The pair of locking pliers according to claim 1, wherein the end of the connecting rod which connects to the sliding mechanism consists of curve segments, and a curvature of a curve segment close to the first handle is larger than that away from the first handle.

3. The pair of locking pliers according to claim 1, wherein the connecting rod is made of medium-carbon and high-strength carbon structural steel or high-carbon steel.

4. The pair of locking pliers according to claim 1, wherein the connecting rod is mounted to the second handle via a rivet at the second joint and to the sliding mechanism via a pin at the third joint.

5. The pair of locking pliers according to claim 1, wherein the locking mechanism is slidably mounted to the first handle, and located on a side of the sliding mechanism close to a distal end of the first handle.

6. The pair of locking pliers according to claim 1, wherein the locking plates are multiple and the multiple locking plates cling to each other.

7. The pair of locking pliers according to claim 1, the wherein a cross-section of the guide rod is a rounded trapezoid and a hole for the guide rod to pass through is arranged in a middle of the locking plates, the hole being arranged to be provided with a rounded trapezoid in a same shape with the cross-section of the guide rod, a fit between the guide rod and the locking plates being a clearance fit.

8. The pair of locking pliers according to claim 1, wherein the adjusting mechanism is configured such that when the adjusting mechanism reaches a maximum displacement towards either end of the guide rod and the pair of locking pliers is locking, a right most end of the connecting rod can contact with the adjusting mechanism.

9. The pair of locking pliers according to claim 1, wherein a cross-section of the carrier is a same as that of the locking plates and has a hole with a same shape and size and at a same position as that of the locking plates, the guide rod passing through the hole in the carrier.

10. The pair of locking pliers according to claim 1, wherein the pair of locking pliers also comprises a third handle, which is pivotably mounted to the second handle and is configured such that: when the end of the third handle away from a pivot point is approaching the second handle, the end of the third handle close to the pivot point can act on the connecting rod.

11. The pair of locking pliers according to claim 10, the wherein a part of the connecting rod interacting with the third handle is provided with an arc-shaped projection.

* * * * *